United States Patent [19]

Sanderson

[11] Patent Number: 4,496,473

[45] Date of Patent: Jan. 29, 1985

[54] HYDROGEN PEROXIDE COMPOSITIONS

[75] Inventor: William R. Sanderson, Warrington, England

[73] Assignee: Interox Chemicals Limited, London, England

[21] Appl. No.: 484,209

[22] Filed: Apr. 12, 1983

[30] Foreign Application Priority Data

Apr. 27, 1982 [GB] United Kingdom ..... 8212149

[51] Int. Cl.[3] ..... C11D 7/54

[52] U.S. Cl. ..... 252/186.41; 252/95; 252/104; 424/62

[58] Field of Search ..... 252/95, 104, 186.41; 424/62

[56] References Cited

U.S. PATENT DOCUMENTS

| | | | |
|---|---|---|---|
| 3,859,223 | 1/1975 | Castrantas et al. | 252/170 |
| 3,997,659 | 12/1976 | Knohl et al. | 252/186.41 |
| 4,367,156 | 1/1983 | Diehl | 252/186.41 |

*Primary Examiner*—Leland A. Sebastian
*Attorney, Agent, or Firm*—Larson and Taylor

[57] ABSTRACT

The effectiveness of hydrogen peroxide for bleaching and disinfecting at ambient to hand hot temperatures can be enhanced by reaction with a peracid generator (activator), but the provision of storage stable concentrated aqueous liquid premixes of hydrogen peroxide and activator presents many problems arising from the physical and chemical properties of the components.

The present invention provides aqueous acidic emulsions of hydrogen peroxide and enol esters, preferably at a pH of 2 to 5 and containing a slight excess of hydrogen peroxide over an equivalent mole ratio to enol ester activator of 1:1.

The concentrations of the components of some preferred emulsions are selected in the ranges of 3 to 20% hydrogen peroxide, 30 to 85% water, 10 to 30% enol ester (%s by weight based upon the emulsion) and from 10 to 70% by weight based on the enol ester of emulsifiers.

In preferred compositions, the activator is selected from vinyl or isopropenyl or but-1-enyl or cyclohex-1-enyl acetate or benzoate and divinyl adipate or phthalate, and 1,5-diacetoxypenta-1,4-diene.

The compositions can be used as such or upon dilution with aqueous media and in conjunction with detergent compositions, and for cleaning and disinfecting absorbent or non-absorbent materials.

13 Claims, No Drawings

HYDROGEN PEROXIDE COMPOSITIONS

The present invention relates to hydrogen peroxide compositions and more particularly to aqueous hydrogen peroxide compositions containing additionally a peracid generator, and to processes for the manufacture of such compositions and their use in washing, bleaching, or disinfection.

For many years, bleach or disinfectant compositions containing hydrogen peroxide or a compound that generates hydrogen peroxide upon dissolution in water have been readily available. It has also been recognised that hydrogen peroxide is a much more effective bleach at temperatures approaching 100° C. than at hand hot washing temperatures and in order to improve the bleaching performance of hydrogen peroxide at such low washing temperatures, the use has been proposed of various types of compounds which react with the hydrogen peroxide to generate a peracid species, especially in aqueous alkaline media. In addition to being able to bleach more effectively at lower washing temperatures, the peracids so formed tend to be more effective disinfectants. Many of the compounds that generate peracids, sometimes otherwise called activators or bleach activators, are solid at ambient temperature even in tropical climates, and they therefore can readily be incorporated in solid particulate bleaching or disinfectant compositions, possibly after various protective coatings or other stabilising techniques have been applied to them, as for example described in British Patent Specification No. 1,398,785. It will be be recognised that the usage of bleaching or disinfectant compositions is often domestic, so that a composition containing both precompound and activator is inherently considerably more convenient to use than two compositions that must be mixed in the appropriate ratio immediately prior to use. However, in respect of liquid bleach or disinfectant compositions containing hydrogen peroxide as the percompound, there are considerable difficulties in providing dilutable bleach and activator compositions (concentrates). An ideal bleach/activator composition would simultaneously meet the following criteria:

1. it would rapidly dissolve in a subsequent washing/-bleaching solution so as to minimise the problems of localised bleaching, pin-holing or the like associated fabric damaging properties:

2. the activator would react with hydrogen peroxide in the washing/disinfection medium at hand hot temperatures or lower, so as to generate the more active bleaching and disinfectant compound:

3. the effectiveness of the composition would be retained even after many months storage on the shelf and in practice this means to a great extent minimising the interaction between the hydrogen peroxide and the activator in the concentrate:

4. the liquid concentrate would remain an homogeneous mixture, otherwise relative dosages of the two components would vary from the first to the last portion of the composition:

5. the concentrate could be safely stored both in bulk and in household containers.

Various of these criteria are mutually incompatible to a greater or lesser extent. Thus for example, the desire for rapid reaction between the two components in use is to be contrasted with the desire to avoid reaction between the two components during storage prior to use.

The problem is compounded by the fact that many of the known activators have low water solubility so that solutions require the presence of a co-solvent, usually a low molecular weight aliphatic alcohol such as ethanol or isopropanol or a polyol, often as a high proportion of the concentrate composition, with all the inherent potential troubles arising from low flash point or preferential evaporation of part of the solvent system.

The topic of activation of hydrogen peroxide has been the subject of considerable research effort during the last 30–40 years, with the result that there have been very many different patents and articles relating to the use of various types of compounds as activators, one compilation indicating nearly 400, excluding equivalents. Each of the patents refers to a range of compounds, and indeed several of them, particularly the earlier ones, relate to many classes of compounds. Of these many compounds only a very small number have ever progressed beyond the laboratory bench so that although each disclosure would suggest to an uncritical reader that the compounds disclosed can be readily employed, the practice in the last 30 years has been otherwise. Faced with a bewildering array of discarded activators, there is little sound reason for the researcher of today selecting any one of them rather than any other. Now, one such patent disclosing several classes of potential activators is British Patent Specification No. 836,988, which describes a test to sort the acceptable from the unacceptable, and in which several classes of carboxylic acid esters were identified. However, the compounds disclosed therein would be discarded by the research worker seeking to produce a storable composition based on aqueous hydrogen peroxide, in the GBPS No. 836,988 discloses that bleaching solutions prepared with hydrogen peroxide should be prepared as required for use and subsequently it states that compositions according to the invention must not contain water in an amount sufficient to permit appreciable chemical reaction between the components prior to use. Certain of the activators subsequently described herein have also been described in DE OS No. 3003351, but this specification also teaches that the activators which are enol esters are relatively unstable with respect to moisture and that they can be stored for much longer periods if in so far as they are liquid at ambient temperature, they are absorbed on a three dimensionally cross-linked macromolecular water-insoluble inorganic compound such as zeolite. Surprisingly, it has been found that aqueous hydrogen peroxide-based liquid concentrates containing certain esters and having an acceptable storage stability can be produced.

Various other of the activators subsequently described herein have been described in U.S. Pat. No. 4,283,301, but once again the patentee specifies (see column 10) that when the peroxygen compound and the activator are dry mixed, moisture or free water in such a composition should be minimised so as to prevent formation of the peroxyacid species outside the bleaching or laundering solution, i.e. its premature formation leading to accelerated avox loss. Accordingly, the specification confirms the earlier teaching of keeping the activator and peroxygen compound apart from water during storage.

According to the present invention, there is provided a bleach or disinfection composition comprising an aqueous acidic solution of hydrogen peroxide having dispersed therein an organic phase with an emulsifying amount of an emulsifier therefor, said organic phase comprising an enol ester having either of the following general formulae:

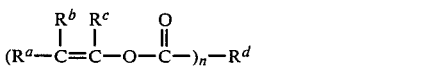

(i)

or

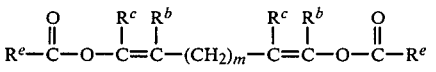

(ii)

in which each of $R^a$ and $R^b$ represent hydrogen or a $C_1$ to $C_5$ alkyl radical or a $C_2$ to $C_4$ alkenyl radical or a phenyl radical, $R^a$ and $R^b$ being the same or different or combining together to form a carbocyclic di-radical, $R^c$ represents hydrogen or a $C_1$ to $C_5$ alkyl radical or a phenyl radical or is combined with $R^a$ or $R^b$ and the olefin group to form a carbocyclic radical, $R^e$ represents hydrogen or a $C_1$ to $C_3$ alkyl radical or a phenyl radical, n is 1 or 2, when n=1, $R^d$ represents hydrogen or a $C_1$ to $C_3$ alkyl radical or a phenyl radical, when n=2, $R^d$ represents a $C_2$ to $C_{10}$ alkylene di-radical or a phenylene di-radical, and m is an integer from 0 to 8.

Herein, the the term emulsifier therefor is meant a single emulsifier or combination of emulsifiers which has an HLB value (hydrophile-lipophile balance) the same as, or at least not differing in practice significantly from the corresponding value for the enol ester activator or combination of enol ester activators such that the activator is dispersed in the composition.

In many embodiments $R^a$, $R^b$ and $R^c$ in the formulae for the activator, are each often selected as follows: $R^a$ from hydrogen, methyl or ethyl radicals, and $R^b$ and $R^c$ from hydrogen or methyl radicals or $R^a$ and $R^c$ combine with the olefin moiety to form a $C_5$ or $C_6$ carbocyclic radical and $R^b$ from hydrogen and methyl radicals. $R^a$, $R^b$ and $R^c$ can be selected independently from each other. Various examples of moieties derived from the enols which are highly favoured include vinyl, isopropenyl, isobutenyl, n-butenyl, and cyclohexenyl moieties. $R^d$ and $R^e$ in the formulae are often selected from methyl, ethyl and phenyl, and $R^d$ additionally from phenylene and $C_2$–$C_4$ polymethylene radicals. In formula (ii) m is often 0, 1, or 2. It will be further recognised that it is convenient to select activators that are liquid in themselves or with the emulsifier readily form liquid droplets or readily suspended particles under the conditions of manufacture of the emulsion. Accordingly, highly favoured activators from formula (i) include vinyl acetate, isopropenyl acetate, butenyl acetate, divinyl glutarate, divinyl adipate, divinyl azelate, divinyl sebacate, vinyl benzoate, isopropenyl benzoate, divinyl phthalate or isophthalate or terephthalate, divinyl hexahydrophthalate or cyclohexenyl acetate and from formula (ii) include glutardienol diacetate (1,5-diacetoxypenta-1,4-diene) and succindienol diacetate (1,4-diacetoxybuta-1,3-diene). Naturally, the corresponding propionates to the aforementioned highly favoured acetate activators can be employed alternatively. Furthermore, any two or more of the activators can be employed in combination, if desired, for example in order to assist the formation of a liquid activator phase employing a higher molecular weight activator in conjunction with a lower molecular weight activator.

Other examples of $R^a$ or $R^b$ include vinyl and propenyl radicals. In addition, it will also be recognised that where two enol ester groups are present in the formulae, the corresponding compounds in which only one of the enol groups or the carboxylic acid groups as the case may be is esterified are also usable as an activator. Thus, for example the monovinyl ester of adipic acid is usable and likewise the monoacetate ester of glutaraldehyde.

Various of the enol esters are commercially available. It has been found that those that are not can readily be made by one or more of the methods of esterification, having selected the appropriate enolisable carbonyl compound and the appropriate carboxylic acid chloride, anhydride or ketene under conditions known to chemists to promote enol ester formation for isopropenyl acetate and closely related compounds, or the processes disclosed in GBPS No. 827,718, or in the articles by Bedoukian in J.Am Chem Soc 1964, V66, p1326 and by Verekenova in Zh Obshch Khim 1963, V33, p91.

In the present composition, it is preferable to employ the activator in a mole ratio of enol ester equivalent (EEE): hydrogen peroxide of from 5:1 to 1:10. It will be recognised that for activators in which n is 1, there is one enol ester equivalent per mole of activator and for activators in which n is 2 and activators of formula (ii) there are two EEEs per mole of activator. In practice, the EEE:$H_2O_2$ ratio is selected more frequently within the range of 3:2 to 1:5, often being about 1:1 or from 1:1 to 2:3, i.e. using a stoichiometric amount or a slight excess of hydrogen peroxide.

The aqueous hydrogen peroxide normally comprises from 40 to 95% by weight of the composition and correspondingly the organic phase, mainly the activator and emulsifier comprises the balance of from 60 to 5% by weight. This corresponds to a weight ratio between the organic and aqueous phase on mixing normally of from 1:20 to 2:3 and in many instances this ratio is selected in the range of 1:9 to 1:1. The concentration of hydrogen peroxide is normally at least 1%, desirably at least 3% and conveniently is not more than 20% and quite often not more than 10%, all by weight of the composition. In many of the instant compositions, hydrogen peroxide concentration is in the range of 4 to 8% by weight of the composition. The balance of the aqueous phase comprises water which in practice is often in the region of 30 to 85% of the composition weight. The aqueous phase also contains sufficient water-soluble acid to generate an acidic pH, preferably from pH2 to pH5. Such a pH may often be obtained in the aqueous phase of the emulsion in practice by dilution of commercially available hydrogen peroxide solutions which contain a small amount of acidic stabilisers such as pyrophosphoric acid and/or one or more phosphonic acids with demineralised water, and often on emulsification a small proportion of organic acid from the activator can transfer into the aqueous phase. The pH of the composition can readily be monitored and if necessary adjusted to the preferred range by suitable acid or base introduction. The aqueous phase can additionally contain a small amount of a thickener, such as about 0.5% by weight of the composition of a xanthan gum, the precise amount being variable at the discretion of the manufacturer to obtain a desired viscosity.

The concentration of activator in the composition is normally selected in the range of from 3 to 35% by weight and in many embodiments is often from 10 to 30% by weight, and of course it will be recognised that the higher molecular weight activators tend to be present in somewhat higher concentrations than the lower molecular weight activators, in order to achieve a similar mole ratio to the hydrogen peroxide. Thus, for activators having an equivalent molecular weight of up to 100 the proportion of activator is preferably from 10 to 20% by weight, for activators having an equivalent molecular weight of over 100 to 130 the proportion is preferably from 15 to 25% and for activators having a molecular weight of over 130, the proportion is preferably from 20 to 30% by weight, and these proportions can be achieved by employing weight ratios of organic phase to aqueous phase of respectively 1:9 to 1:3, 1:5 to 2:3 and 2:9 to 1:1. It will be recognised that for activators containing two EEEs, the equivalent molecular weight to be employed is half the actual molecular weight.

The amount of emulsifier or emulsifiers usually employed is at least 5% to 10% by weight based on the activator, and indeed in many desirable compositions is from 10% to 70% likewise based. The major part or all of the emulsifiers is often premixed with the activator before subsequent dispersion in the aqueous hydrogen peroxide, the amount in many cases comprising 100% to 50% of the weight of the activator. However, it is possible for some of the emulsifier combination to be pre- or post-mixed in the aqueous phase, especially in respect of an anionic emulsifier, in which case for example up to 50% and typically at least 5% of such emulsifiers by weight based on the activator can be so added in the aqueous phase. Advantageously, it has been found in some embodiments that transparent emulsions can be obtained, such as by including an anionic emulsifier as well as a nonionic emulsifier and employing at least about half as much emulsifier as activator. All or part of the anionic emulsifier can in the main be added in either phase at the discretion of the formulator. In addition to the foregoing components, the compositions can also contain one or more dyes or perfumes, preferably those which have demonstrable resistance to attack by peroxygen compounds, usually in an amount of less than 0.5% by weight. Since the compositions may be used for the bleaching of absorbent materials, it may also be advantageous to add an optical brightening agent to the formulation. This would usually be employed in an amount not greater than 2% by weight, often from 0.5 to 1%, and should also be resistant to attack by peroxygen compounds.

In general, the emulsifiers employed in the instant invention can be described as fatty acid esters or fatty ethers or amines of a polyhydroxy substituted compound or a polyethoxylate. Within such general headings, the emulsifiers can be classified more closely as glycerol fatty acid esters, derivatives of lanolin, sorbitan fatty acid esters, POE alkyl phenols, POE amines, POE fatty acid esters, POE fatty alcohols, and in addition the emulsifiers can be POE/POP block condensates, or alkyl esters of sulphosuccinates or linear alkylbenzene sulphonates. In the foregoing, fatty indicates that the fatty alcohol or fatty acid moiety has a linear carbon chain length of at least 8 carbon atoms, often up to 26 carbon atoms and in many cases from 12 to 20 carbon atoms, POE designates polyoxyethylene and POP polyoxypropylene. As has been referred to hereinbefore, to achieve good emulsification the HLB value of the emulsifiers is matched to that of the organic component. Where the HLB value of the potential emulsifier is not known, it can often be determined using the appropriate known method, one of which is based on the oxyethylene content of the emulsifier and another is based on the saponification value thereof and the acid number of the fatty acid moiety thereof. For mixtures of nonionic emulsifiers, the resulting HLB value can be obtained by a weighted average of the component emulsifiers. A non-exhaustive list of examples of emulsifiers which, if they do not have the desired HLB value alone can be combined to provide the matching value, are as follows:

| Chemical designation | Type | HLB value |
|---|---|---|
| ethylene glycol monostearate | N | 2.9 |
| sucrose distearate | N | 3.0 |
| propylene glycol monostearate | N | 3.4 |
| glycerol monooleate | N | 3.4 |
| diglycerine sesquioleate | N | 3.5 |
| sorbitan sesquioleate | N | 3.7 |
| acetylated monoglycerides (stearate) | N | 3.8 |
| decaglycerol octaoleate | N | 4.0 |
| diethylene glycol monostearate | N | 4.3 |
| sorbitan monooleate | N | 4.3 |
| propylene glycol monolaurate | N | 4.5 |
| POE (1.5) nonyl phenol (ether) | N | 4.6 |
| sorbitan monostearate | N | 4.7 |
| POE(2) oleyl alcohol (ether) | N | 4.9 |
| POE(2) stearyl alcohol (ether) | N | 5.0 |
| PEG 200 distearate | N | 5.0 |
| decaglycerol tetraoleate | N | 6.0 |
| PEG 300 dilaurate | N | 6.3 |
| sorbitan monopalmitate | N | 6.7 |
| N,N—dimethylstearamide | N | 7.0 |
| PEG 400 distearate | N | 7.2 |
| POE(5) lanolin alcohol (ether) | N | 7.7 |
| POE octylphenol (ether) | N | 7.8 |
| diacetylated tartaric acid esters of monoglycerides | N | 8.0 |
| POE(4) stearic acid (monoester) | N | 8.0 |
| sorbitan monolaurate | N | 8.6 |
| POE(4) nonylphenol (ether) | N | 8.9 |
| isopropyl ester of lanolin fatty acids | N | 9.0 |
| POP/POE condensate | N | 9.5 |
| POE(5) sorbitan monooleate | N | 10.0 |
| POE(40) sorbitol hexaoleate | N | 10.2 |
| PEG 400 dilaurate | N | 10.4 |
| POE(5) nonylphenol (ether) | N | 10.5 |
| POE(20) sorbitan tristearate | N | 10.5 |
| POE(20) lanolin (ether and ester) | N | 11.0 |
| POE(8) stearic acid (monoester) | N | 11.1 |
| POE(50) sorbitol hexaoleate | N | 11.4 |
| POE(10) stearyl alcohol (ether) | N | 12.4 |
| POE(8) tridecyl alcohol (ether) | N | 12.7 |
| POE(10) cetyl alcohol (ether) | N | 12.9 |
| PEG 400 monolaurate | N | 13.1 |
| POE(10) nonylphenol (ether) | N | 13.3 |
| POE(15) tall oil fatty acids (ester) | N | 13.4 |
| POE(24) cholesterol | N | 14.0 |
| sucrose monolaurate | N | 15.0 |
| POE(16) lanolin alcohols | N | 15.0 |
| acetylated POE(9) lanolin | N | 15.0 |
| PEG 1000 monooleate | N | 15.4 |
| POE(20) sorbitan monopalmitate | N | 15.6 |
| POE(25) propylene glycol monostearate | N | 16.0 |
| PEG(1000) monolaurate | N | 16.5 |
| POE(20) sorbitan monolaurate | N | 16.9 |
| POE(23) lauryl alcohol (ether) | N | 16.9 |
| POE(40) stearic acid (monoester) | N | 16.9 |
| POE(25) soyasterol | N | 17.0 |
| POE(30) nonylphenol (ether) | N | 17.1 |
| PEG 4000 distearate | N | 17.3 |
| POE(50) stearic acid (monoester) | N | 17.9 |
| POE(70) dinonylphenol (ether) | N | 18.0 |
| POE(20) castor oil (ether, ester) | N | 18.1 |

These emulsifiers are listed in increasing HLB value from the lowest exemplified at 2.9 through to the highest exemplified at 18.1. It will be recognised that there are other and closely related emulsifiers to one or more of the emulsifiers listed hereinbefore which will have similar characteristics or characteristics having a predictable difference. For example, the PEG 400 monostearate has an HLB value approximately 1.4 units lower than the PEG 400 monolaurate emulsifier listed and the POE(20) cetyl alcohol (ether) has an HLB value 2.8 higher than the corresponding POE(10) cetyl alcohol (ether). It is often highly desirable to select emulsifiers in which the fatty acid moiety is fully saturated, such as laurate, palmitate or stearate.

The aqueous emulsions of the instant invention can be prepared using activator, emulsifier, hydrogen peroxide and water in the proportions described hereinbefore, in a series of steps comprising:

forming an organic phase by mixing together the activator with at least the major weight part of the emulsifier or emulsifiers, at a temperature of below the boiling point of the enol ester, and usually at no more than up to 70° C., thereby intimately contacting both components together;

separately preparing an aqueous solution of hydrogen peroxide and the balance, if any, of emulsifier, especially if the latter is anionic, at a concentration of hydrogen peroxide sufficient to provide the desired amount thereof in the emulsion, said concentration often being selected in the range of 5 to 25% by weight of the aqueous phase, usually at a temperature of below 50° C., and preferably from 10° to 25° C.;

bringing into contact the aqueous hydrogen peroxide solution with the organic phase comprising emulsifier and activator, in the appropriate weight ratio and subsequently or simultaneously subjecting the resultant mixture to a shearing force sufficient to disperse the organic phase, normally at a temperature of the mixture below 50° C. and this range preferably includes the natural temperature obtained by mixture of the two phases.

There are several variations in the mode of bringing the two phases into contact, including batch processes in which one phase is introduced into a body of the other phase or the alternate or simultaneous introduction of each phase into a body of the mixed phase, followed by withdrawal of the mixture to the point of shear and formation of the emulsion. In other techniques, both phases can be introduced simultaneously and continuously to a shearing zone in which emulsion is formed continuously and then passed to a storage vessel. In yet a further modification a concentrated emulsion can be formed, for example by using a hydrogen peroxide solution of 25% to 50% by weight together with the appropriate mole ratio of activator and the emulsion diluted later with water to provide the emulsion that would be made available to the domestic user, i.e. to a hydrogen peroxide concentration of 3 to 20% and preferably 4 to 8%. Advantageously such a procedure could minimise transport costs for the intermediate product.

Where additional ingredients are employed they are often introduced into the more receptive phase. Thus, some such as thickeners often are added to the aqueous phase, others such as perfumes often to the organic phase and still others such as dyes or optical brightening agents may be added in either phase, depending on their nature. Aqueous phase additions can be made either prior or subsequent to emulsion formation, but organic phase additions are normally made prior to emulsion formation. Advantageously, for many embodiments of the invention, the entire process can be carried out at a temperature of between ambient and 40° C. A higher temperature is of advantage only for those activators or emulsifiers which have melting points in excess of 40° C., or high viscosities at 40° C. and below. Where a temperature for the organic blending step of over 40° C. is employed to enhance the rate at which homogenisation of the organic phase is achieved, the organic phase may be cooled to below 40° C. before contact with the aqueous phase, thereby minimising the period when the emulsion has a high temperature.

The process of manufacture can be carried out on a small scale using planetary mixers, motor driven propellers, turbines, colloid mills and homogenisers and even using high speed blenders or food processors. Similar types of apparatus can be employed on a plant scale employing for example rotating paddles, rotating simple or complex propellers, turbine-type agitators, colloid mills, homogenizers, or high-frequency ultrasonic emulsifiers. It will be recognised that the breakdown or dispersion of the organic phase need not be accomplished in a single stage, but may be carried out in a succession of stages using the same or different types of equipment.

Advantageously emulsions of the instant invention can be readily diluted by mixture with water or an aqueous alkaline or acidic medium to the extent needed in their use. Such dilution in practice can often be as much as up to 1000 or 2000 fold.

The instant invention emulsions are primarily directed towards two uses. In one use, the emulsion is used as a low temperature acting bleach in the washing or laundering of household fabrics or in the cleaning of non-absorbent articles in the home or in processes for cleansing and/or sterilising apparatus or other hard surfaces, such as tanks, pipes, bottles or other containers or for the bleaching of cellulose, in the form of pulp, paper, yarn, thread or cloth, under similar process conditions to those in which hydrogen peroxide or the developed peroxyacid can itself be employed. By way of example, the liquid bleach emulsion can be employed in a domestic or commercial laundry process in conjunction with any washing composition in order to enable that composition to be employed at low wash temperatures and achieve good stain oxidation. Such washing compositions can be used in their usual amounts, such as from 0.5 to 10 g/l and comprise one or more anionic surfactants, including soaps and synthetic detergents usually an alkyl aryl sulphonate, an alkyl sulphate and/or an alcohol sulphate, and/or one or more non-ionic surfactants including primary or secondary alcohol ethoxylates, or a zwitterionic detergent or an ampholytic detergent or a cationic detergent and the washing composition can also include one or more detergent builders, and conventional adjuncts such as soil anti-redeposition agents, buffers, optical brighteners, suds control agents, etc.

When the emulsion of instant invention is employed in conjunction with a solution of such an aforementioned washing composition, the resultant aqueous washing solution generally has an alkaline pH, frequently from pH8 to pH10, which promotes the perhydrolysis of the activator resulting in formation of a peracid or anionic species. Alternatively, it is possible to employ the bleach in a subsequent rinsing stage of a washing process in that there is often sufficient alkaline solution retained by the articles being washed to promote a mildly alkaline pH in at least the first rinse. In either method of use, though, it is usual to employ a concentration of hydrogen peroxide and activator which can generate theoretically a concentration of available oxygen (avox) in the washing/bleaching water in the peracid form of from 5–200 ppm and often from 10–50 ppm peracid avox. For an emulsion containing 10% hydrogen peroxide and about 18% vinyl acetate, a peracid avox in the wash solution of 25 ppm can be obtained by addition of about 0.8 g emulsion per liter of washing solution. Corresponding amounts can be calculated for other emulsions.

The second important use of the emulsions described herein is in the disinfection of aqueous media and, as briefly referred to earlier herein, the disinfection and/or sterilisation of surfaces that come into contact with humans or animals or their food or drink. In such an application, it is desirable to obtain a concentration of disinfectant species matched to the time available to carry out the disinfection. For processes in which the contact time is expected to be long, concentrations of as low as 100 ppm emulsion can be employed but where the contact time is likely to be a matter of a few seconds or at the longest a few minutes, a much higher concentration of emulsion is often preferable, for example up to a concentration of 10 gpl. Generally, disinfection or sterilising solutions can be made by simple dilution of the emulsion by an aqueous medium but if desired, sufficient alkali to generate a pH of 7–8.5 can be added. It has been found, particularly in respect of enol esters derived from dialdehydes, for example 1,5-diacetoxypenta-1,4-diene or 1,4-diacetoxybuta-1,3-diene, that pH of 7 or mildly alkaline to pH 8 tends to encourage the rate at which, and the extent to which the combination of activator plus hydrogen peroxide (or generator thereof) kills bacteria, such as spore-forming bacteria. At such pH's there would appear to be an enhanced capability.

Having described the invention in general terms, specific examples will hereinafter be described in greater detail.

EXAMPLES

Examples 1 to 20

In these Examples, aqueous hydrogen peroxide emulsions containing an activator were prepared by four methods. In method 1, the organic phase was prepared by mixing all the emulsifiers with the activator at ambient temperature or warmed as necessary to bring the organic phase to an homogeneous mix. The aqueous phase was prepared by diluting a standard 35% aqueous hydrogen peroxide (available commercially from Interox Chemicals Limited) with demineralised water containing the selected thickener, a xanthan gum available under the trade name Kelzan from ABM Chemicals, if any was used. The aqueous phase was then introduced gradually into the organic phase with vigorous stirring for a period of 5 minutes by which time an emulsion had been formed. Certain of the emulsions were opaque, indicated in the following Table 1 by O, whilst others were transparent, indicated by T, the latter demonstrating the formation of a micro emulsion.

In method 2, method 1 was followed with the exception that the greater part of the emulsifiers was introduced into the organic phase but the balance of them was introduced into the aqueous phase.

In method 3, method 1 was followed but the thickener was not introduced into the aqueous phase initially, but instead was introduced into the formed emulsion which then was vigorously stirred for thirty minutes.

In method 4, method 3 was adopted, but the thickened emulsion was stirred for only two and a half minutes and then shaken for half a minute.

The perfume, where present, was mixed in with the organic phase before emulsification, but any water-soluble dye or perfume would have been added to the aqueous phase in the same ways as the thickener could be.

The components of the emulsions are as follows:

E1 sorbitan ester (SPAN 60 from ICI Americas Inc)
E2 sorbitan ester (TWEEN 60 from ICI Americas Inc)
E3 alcohol ethoxylate (SYNPERONIC A7 from ICI plc)
E4 alcohol ethoxylate (SYNPERONIC A11 from ICI plc)
E5 nonylphenol ethoxylates (SYNPERONIC NP10 from ICI plc)
E6 nonylphenol ethoxylates (SYNPERONIC NP13 from ICI plc)
E7 dialkyl sulphosuccinates (AEROSOL OT75 from Cyanamid)
E8 dialkyl sulphosuccinates (AEROSOL OT100 from Cyanamid)
E9 dialkyl sulphosuccinates (AEROSOL TR70 from Cyanamid)
E10 alcohol ethoxylate (ETHYLAN CD919 from Diamond Shamrock)
E11 alcohol ethoxylate (SYNPERONIC A3 from ICI plc)
E12 nonylphenol ethoxylate (SYNPERONIC NP4 from ICI plc)

In Examples 1–14, the activator was vinyl benzoate, in Examples 15–19 the activator was divinyl adipate and in Example 20 the activator was methylprop-1-enyl acetate.

TABLE 1

| Ex | Weight % of components in emulsion | | | | | | | | |
|---|---|---|---|---|---|---|---|---|---|
| | Aqueous phase addn | | | Organic phase addn | | | | | |
| No | $H_2O_2$ | $H_2O$ | Others | Emulsifiers | | Perfume | Activator | Way Made | Type |
| 1 | 6.2 | 63.5 | K/0.5 | E1/0.34 | E2/2.35 | — | 27.1 | 1 | O |
| 2 | 6.1 | 61.7 | K/0.5 | E3/0.94 | E4/4.34 | — | 26.4 | 1 | O |
| 3 | 6.0 | 58.0 | K/0.5 E8/4.0 | E5/3.91 | E6/1.44 | — | 26.1 | 2 | O |
| 4 | 6.0 | 57.3 | K/0.3 E8/4.0 | E6/6.6 | | — | 25.9 | 3 | O |
| 5 | 5.7 | 57.4 | | E7/9.40 | | 3.1 | 24.4 | 4 | O |
| 6 | 5.7 | 57.4 | | E7/3.70 | E9/5.60 | 3.1 | 24.4 | 4 | O |
| 7 | 5.6 | 56.1 | | E7/6.10 E4/7.20 | E3/1.10 | | 23.9 | 4 | T |
| 8 | 5.7 | 57.4 | | E7/6.20 | E6/6.20 | | 24.4 | 4 | T |
| 9 | 5.7 | 57.4 | | E7/4.70 | E6/7.80 | | 24.4 | 4 | T |
| 10 | 5.5 | 55.6 | | E7/6.10 | E6/6.10 | 3.1 | 23.7 | 4 | T |
| 11 | 5.9 | 59.2 | | E7/9.70 | | | 25.2 | 4 | O |

TABLE 1-continued

| Ex No | Weight % of components in emulsion Aqueous phase addn $H_2O_2$ | $H_2O$ | Others | Organic phase addn Emulsifiers | | Perfume | Acti-vator | Way Made | Type |
|---|---|---|---|---|---|---|---|---|---|
| 12 | 5.9 | 59.2 | | E7/3.87 | E9/5.80 | | 25.2 | 4 | O |
| 13 | 5.5 | 55.6 | | E7/4.50 | E6/7.60 | 3 | 23.7 | 4 | T |
| 14 | 5.4 | 54.3 | | E7/5.60 | E10/8.60 | 3 | 23.1 | 4 | T |
| 15 | 7.0 | 76.7 | | E1/2.0 | E2/0.7 | | 13.5 | 4 | O |
| 16 | 6.8 | 74.8 | | E1/3.5 | E2/1.7 | | 13.2 | 4 | O |
| 17 | 6.7 | 73.8 | | E11/4.8 | E7/1.6 | | 13.0 | 4 | O |
| 18 | 6.7 | 73.8 | | E11/4.8 | E9/1.6 | | 13.0 | 4 | O |
| 19 | 6.7 | 73.8 | | E12/4.8 | E9/1.6 | | 13.0 | 4 | O |
| 20 | 7.0 | 60.9 | | E11/4.95 | E3/1.85 | | 13.6 | 4 | O |
| | | | | E7/0.85 | E9/0.85 | | | | |
| 21 | 5.1 | 70.1 | | E1/1.7 | E2/2.1 | | 21.0 | 4 | O |

The emulsions were stored in sealed bottles at ambient temperature and after a month had the same physical appearance. The hydrogen peroxide stability was also measured for examples 1–14 and avox losses amounted to only 1.5% per week on average based on the avox present initially except for Example 11 which appeared to lose only 0.3% per week, so that the products have at least an adequate shelf life.

The effectiveness of the emulsions at bleaching stains was tested by washing prestained representative red-wine stained samples of cloth with an aqueous solution of 2 gpl TIDE (lower phosphorus content) available in the USA from Procter and Gamble and sufficient emulsion to provide theoretically 35 ppm peracid avox, in locally available water containing 250 ppm hardness in a weight ratio of calcium:magnesium of 3:1. The trials were carried out at a typical hand-hot washing temperature, 40° C., in a laboratory scale washing machine available from U.S. Testing Corporation under the name Tergotometer. Some samples were removed after 10 minutes, rinsed and dried; the others were removed after 20 minutes.

The reflectance of each sample was measured before and after washing, employing an Instrumental Colour Systems Micromatch reflectance spectrophotometer equipped with a xenon lamp and a D65 conversion filter to approximate to CIE artificial daylight, with UV below 390 nm being cut off. The percentage stain removal was calculated from reflectance readings by the formula:

$$\%\text{Stain Removal } (\%SR) = 100 = (R_w - R_s)/(R_u - R_s)$$

in which $R_w$ represents the reflectance of the washed sample, $R_s$ that of the stained sample before washing and $R_u$ that of the sample before staining. The washing results are summarised in Table 2, together with comparative results showing the effect of adding solely the avox amount of hydrogen peroxide indicated separate addition of the same amounts of hydrogen peroxide and activator as in the emulsion.

TABLE 2

| Bleach Additive | Wash pH Start | end | % Stain Removal 10 mins | 20 mins |
|---|---|---|---|---|
| $H_2O_2$ (35 ppm avox) | 9.2 | 9.2 | 45.7 | 49.0 |
| $H_2O_2$ + equimolar vinyl benzoate | 9.4 | 7.4 | 68.1 | 71.5 |
| Emulsion Ex 1 | 8.2 | 7.2 | 76.4 | 79.5 |
| Emulsion Ex 3 | 8.5 | 7.1 | 76.1 | 78.7 |
| Emulsion Ex 7 | 8.4 | 7.2 | 77.0 | 79.9 |
| Emulsion Ex 10 | 8.6 | 7.2 | 75.7 | 79.2 |
| Emulsion Ex 12 | 8.8 | 7.1 | 77.6 | 79.2 |
| Emulsion Ex 14 | 8.7 | 7.0 | 69.0 | 77.8 |
| $H_2O_2$ (53 ppm avox) | 9.8 | 9.7 | 37.6 | 44.4 |

TABLE 2-continued

| Bleach Additive | Wash pH Start | end | % Stain Removal 10 mins | 20 mins |
|---|---|---|---|---|
| $H_2O_2$ + 217 ppm divinyladipate | 9.2 | 7.7 | 68.3 | 72.7 |
| Emulsion Ex 15 | 9.2 | 7.4 | 64.2 | 68.8 |
| Emulsion Ex 17 | 8.7 | 7.4 | 67.1 | 70.1 |
| Emulsion Ex 19 | 8.2 | 7.1 | 67.9 | 74.6 |

From the foregoing results, it can be seen that emulsions of the instant invention perform very effectively, whilst preserving the advantages of one shot addition of bleach plus activator, in the correct proportions.

I claim:

1. A liquid composition for use in bleaching or disinfection comprising an emulsion containing an aqueous acidic solution of hydrogen peroxide, an organic phase and an emulsifying amount of an emulsifier, said organic phase comprising an enol ester activator having either of the following general formulae:

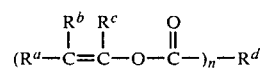

(i)

or

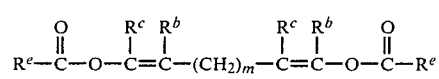

(ii)

in which each of $R^a$ and $R^b$ represent hydrogen or a $C_1$ to $C_5$ alkyl radical or a $C_2$ to $C_4$ alkenyl radical or a phenyl radical, $R^a$ and $R^b$ being the same or different or combining together to form a carbocyclic di-radical, $R^c$ represents hydrogen or a $C_1$ to $C_5$ alkyl radical or a phenyl radical or is combined with $R^a$ or $R^b$ and the olefin group to form a carbocyclic radical, $R^e$ represents hydrogen or a $C_1$ to $C_3$ alkyl radical or a phenyl radical, n is 1 or 2, when n=1, $R^d$ represents hydrogen or a $C_1$ to $C_3$ alkyl radical or a phenyl radical, when n=2, $R^d$ represents a $C_2$ to $C_{10}$ alkylene di-radical or a phenylene di-radical, and m is an integer from 0 to 8.

2. The composition of claim 1 in which the enol ester and hydrogen peroxide are present in an equivalent ratio of from 1:1 to 2:3.

3. The composition of claim 1 in which the concentration of hydrogen peroxide therein is from 3 to 20% by weight thereof.

4. The composition of claim 1 in which the proportion of enol ester activator therein is from 10 to 30% by weight thereof.

5. The composition of claim 1 in which the amount of emulsifier is from 10 to 70% by weight of the enol ester activator.

6. The composition of claim 5 which contains, by weight of the enol ester activator, from 10 to 50% of nonionic emulsifier and from 5 to 50% of anionic emulsifier.

7. The composition of claim 1 in which the aqueous phase has a pH of from 2 to 5.

8. The composition of claim 1 in which the enol ester activator of formula (i) or (ii) satisfies the condition that $R^a$ is a hydrogen, methyl or ethyl radical and $R^b$ and $R^c$ are each hydrogen or methyl radicals.

9. The composition of claim 1 in which the enol ester activator of formula (i) or (ii) respectively satisfies the condition that $R^d$ is an ethyl, methyl, phenyl, phenylene or $C_2$–$C_4$ polymethylene radical or $R^e$ is a methyl, ethyl or phenyl radical.

10. The composition of claim 1 in which the enol ester activator of formula (ii) satisfies the condition that m is 0, 1 or 2.

11. The composition of claim 1 in which the activator is selected from the group consisting of vinyl or isopropenyl or butenyl acetate, divinyl glutarate or adipate or azelate or sebacate, vinyl or isopropenyl benzoate, divinyl phthalate or iso- or tere-phthalate, cyclohexenyl acetate and glutardienol or succindienol diacetate.

12. The composition of claim 1 in which the emulsifier(s) is or are selected from the group consisting of glycerol fatty acid esters, derivatives of lanolin, sorbitan fatty acid esters, POE alkyl phenols, POE amines, POE fatty acid esters, POE fatty alcohols, POE/POP block condensates, alkyl esters of sulphosuccinates and linear alkylbenzene sulphonates.

13. A process for the preparation of a liquid bleach or disinfectant composition which comprises the steps of:

(a) blending together in a chamber or zone one or more enol esters having either of the general formulae:

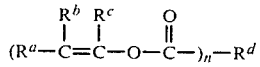

(i)

or

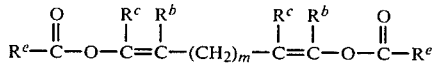

(ii)

in which each of $R^a$ and $R^b$ represent hydrogen or a $C_1$ to $C_5$ alkyl radical or a $C_2$ to $C_4$ alkenyl radical or a phenyl radical, $R^a$ and $R^b$ being the same or different or combining together to form a carbocyclic di-radical, $R^c$ represents hydrogen or a $C_1$ to $C_5$ alkyl radical or a phenyl radical or is combined with $R^a$ or $R^b$ and the olefin group to form a carbocyclic radical, $R^e$ represents hydrogen or a $C_1$ to $C_3$ alkyl radical or a phenyl radical, n is 1 or 2, when n=1, $R^d$ represents hydrogen or a $C_1$ to $C_3$ alkyl radical or a phenyl radical, when n=2, $R^d$ represents a $C_2$ to $C_{10}$ alkylene di-radical or a phenylene di-radical, and m is an integer from 0 to 8 with one or more emulsifiers therefor at a temperature so selected that the resultant blend is in the liquid state, (b) preparing in a second chamber or zone an aqueous acidic solution of hydrogen peroxide, (c) when necessary cooling either or both of the blend and the aqueous solution, so that upon mixing the mixture has a temperature below 50° C., (d) adding, if necessary, emulsifier to the aqueous solution so that the total weight of the emulsifier in said mixture is at least 5% by weight of the enol ester, (e) mixing the blend and the aqueous solution with each other in an equivalent mole ratio of enol ester to hydrogen peroxide within the range 5:1 to 1:10, and (f) subjecting the mixture simultaneously or subsequently to a shearing force thereby to form an emulsion.

* * * * *

UNITED STATES PATENT AND TRADEMARK OFFICE

CERTIFICATE OF CORRECTION

PATENT NO. : 4,496,473

DATED : January 29, 1985

INVENTOR(S) : SANDERSON, William R.

It is certified that error appears in the above-identified patent and that said Letters Patent is hereby corrected as shown below:

Column 3, line 10; and Claim 1, formula (ii) should read:

$$-- R^{e} - \overset{O}{\overset{\|}{C}} - O - \overset{R^{c}}{\overset{|}{C}} = \overset{R^{b}}{\overset{|}{C}} - (CH_2)_m - \overset{R^{b}}{\overset{|}{C}} = \overset{R^{c}}{\overset{|}{C}} - O - \overset{O}{\overset{\|}{C}} - R^{e} \qquad (ii) \quad --$$

Signed and Sealed this

*Twenty-fifth* Day of *March 1986*

[SEAL]

*Attest:*

DONALD J. QUIGG

*Attesting Officer*

*Commissioner of Patents and Trademarks*